United States Patent [19]

Tapinekis

[11] 3,956,851

[45] May 18, 1976

[54] HOOK THE LOOP

[76] Inventor: William Tapinekis, c/o George Spector, 3615 Woolworth Bldg., 233 Broadway, New York, N.Y. 10007

[22] Filed: May 1, 1974

[21] Appl. No.: 465,729

[52] U.S. Cl. ..... 46/220
[51] Int. Cl.[2] ..... A63H 33/02
[58] Field of Search ..... 46/220, 114, 100, 131

[56] References Cited

UNITED STATES PATENTS

| | | | |
|---|---|---|---|
| 2,511,169 | 6/1950 | McAvoy | 46/100 |
| 2,984,937 | 5/1961 | Rendon | 46/220 |
| 3,001,324 | 9/1961 | Walker | 46/220 |
| 3,003,766 | 10/1961 | Stanton | 46/220 X |
| 3,233,361 | 2/1966 | Gonaghan | 46/114 |
| 3,242,612 | 3/1966 | Sakwa | 46/220 |
| 3,535,820 | 10/1970 | Thompson | 46/220 |
| 3,603,028 | 9/1971 | Thorstad | 46/114 |
| 3,676,951 | 7/1972 | Shearer | 46/114 |
| 3,724,126 | 4/1973 | LaGrow | 46/220 |

*Primary Examiner*—Louis G. Mancene
*Assistant Examiner*—Jack Q. Lever

[57] ABSTRACT

An activity toy for small children, consisting of a large circular hoop and a push rod for pushing the hoop so it rolls over a ground, the push rod having a loop at one end to form a handle, the other end having a U-shaped hook for fitting against the rim of the hoop. The hoop periphery rollably supports a weight through a frame and the frane further includes a speed indicator for indicating the speed of the hoop.

3 Claims, 3 Drawing Figures

HOOK THE LOOP

This invention relates generally to children's toys.

A principle object of the present invention is to provide a toy in which a circular hoop is pushed by a push rod held in a child's hand in order to keep the hoop rolling along a ground.

Another object is to provide a Hook the Loop toy in which a U-shaped hook on the end of the push rod grasps around the rim of the hoop so to guide and control its steering direction either straight ahead or toward either side.

Another object is to provide a Hook the Loop toy in which the hook serves to pick up the loop from the ground in case it falls down.

Other objects are to provide a Hook the Loop toy that is simple in design, inexpensive to manufacture, rugged in construction, easy to use and efficient in operation.

These and other objects will be readily apparent upon a study of the following specification and the accompanying drawing wherein.

Figure 1:
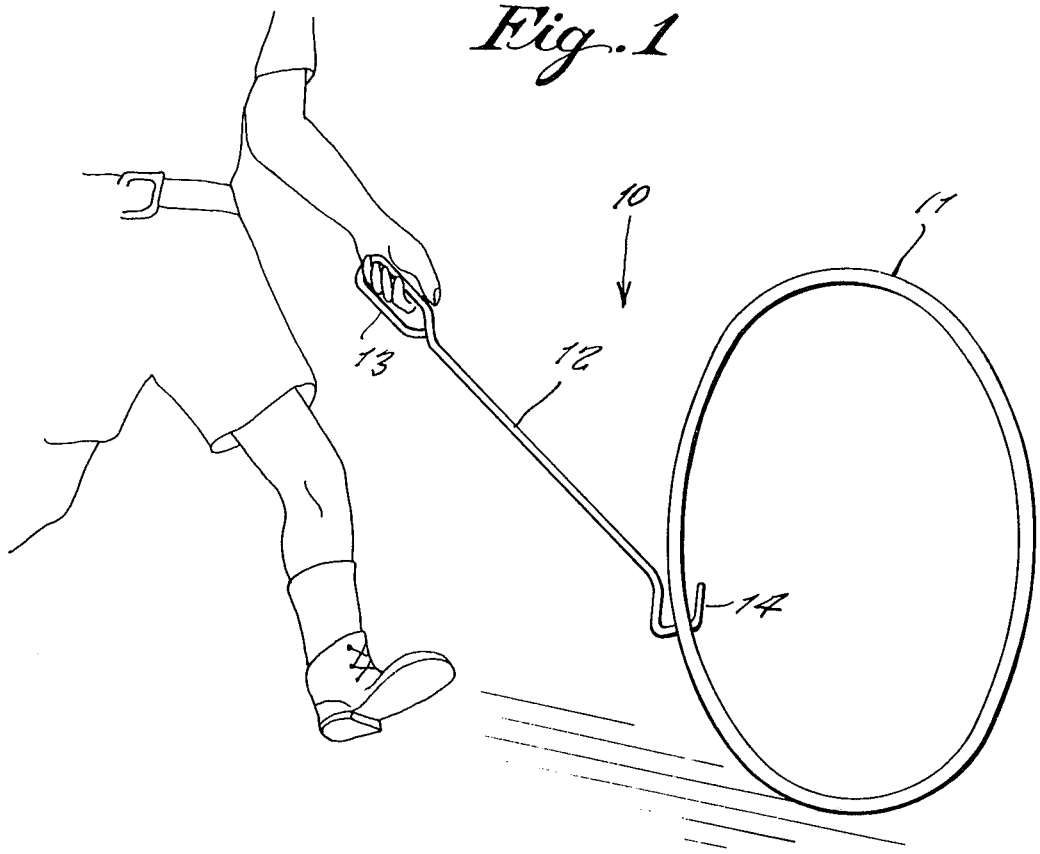
FIG. 1 is a perspective view of the invention.

Referring now to the drawing in detail, the reference numeral 10 represents a Hook the Loop toy according to the present invention wherein there is a circular hoop 11 of about 25 inches diameter and 1½ inch wide.

There is an aluminum push rod 12 of about 25 inches long, having a loop 13 at one end so to form a handle for being held in a hand, and having a U-shaped hook 14 at its opposite end for bearing against the rim of the hoop.

As shown in FIG. 1 the hook 14 will guide the direction of travel of the hoop. A child can walk or run controlling the hoop with a great deal of pleasure.

Figure 2:
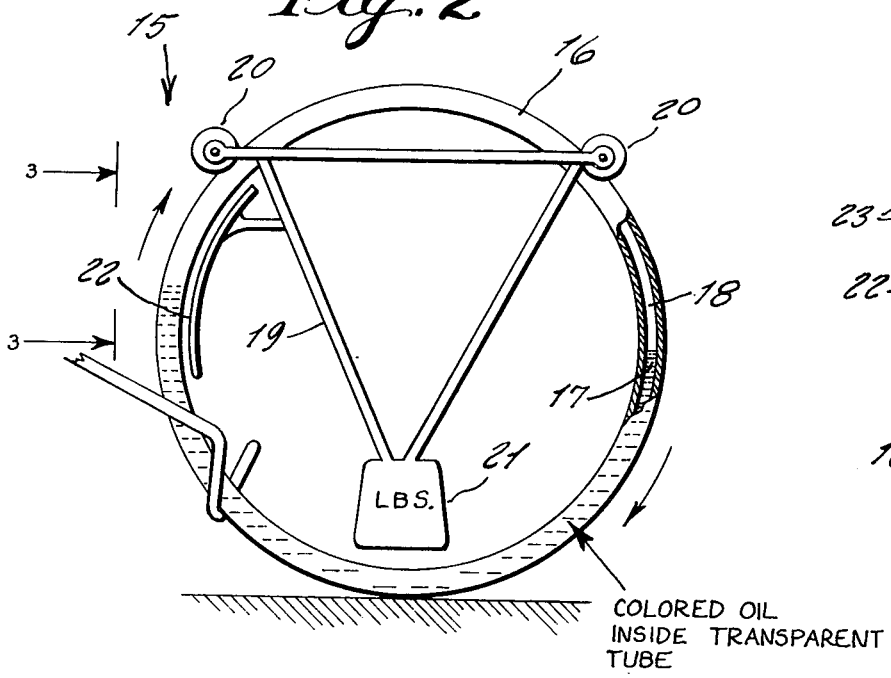
FIG. 2 is a side view of a modified design of the invention which includes a scale for measuring the travel speed of the hoop by including a roller supported frame on the hoop which includes a cabbrated scale for measuring against a level of an oil fluid inside the tubular, transparent hoop.
Figure 3:
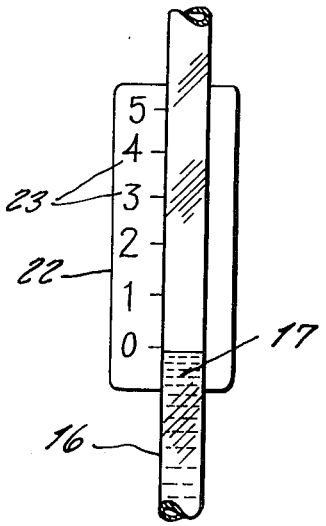
FIG. 3 shows the face of the scale in relation to the oil level.

In FIGS. 2 and 3 a modified design 15 of the invention shows a hoop 16 controlled by the push rod 12.

The hoop 16 is hollow and made of transparent material such as a plastic. A colored liquid such as oil 17 fills about one half the volume of the hollow space 18 of the hoop.

A frame 19 is hung on the hoop by means of a pair of rotatable rollers 20 that ride on the hoop rim as it rotates. The frame has a heavy weight 21 at its lower end so to maintain the frame upright on the hoop and so to prevent the frame from turning as the hoop rotates. The frame accordingly always being erect with the weight extending downward. Accordingly a scale 22 integrally formed on the frame remains stable from turning.

In operative use, as loop 14 is puched by rod 16, the liquid level is horizontal only when the loop travels slowly, but when the loop is made to travel fast, the oil viscosity causes the level to lag so that the oil level can be read against the calibrated numerals 23 on the scale 22, so that the scale forms a type of speedometer for the child, and which can be competitively used to see which child pushes his loop the fastest.

Thus a modifed design is provided.

While various changes may be made in the detail construction, it is understood that such changes will be within the spirit and scope of the present invention as is defined by the appended claims.

What is claimed is:

1. A toy comprising a circular loop and a rod, said rod having a handle at one end and a hook at the opposite end for engaging the loop to propel and guide said loop over a surface, said circular loop including a balancing means, said balancing means including a weight supported by rollers on the loop periphery including suspension means for suspending said weight below the top of said loop, said weight being symmetrically aligned with the center of gravity of said loop, whereby the weight will act as a counterbalance to assist in maintaining the loop substantially in a verticle position as it travels over a surface.

2. A toy as in claim 1, including speed indicating means for indicating speed of rotation of the loop.

3. A toy as in claim 2 wherein the loop is hollow and transparent and the speed indicating means comprises a viscous fluid disposed in said loop filling one half of its volume in combination with a calibrated scale mounted on the suspension means, whereby the level of the liquid can be read relative to said scale.

* * * * *